US011131134B2

(12) United States Patent
Takahashi et al.

(10) Patent No.: US 11,131,134 B2
(45) Date of Patent: Sep. 28, 2021

(54) HINGE ARM DAMPER MECHANISM

(71) Applicant: Tok, Inc., Tokyo (JP)

(72) Inventors: Daisuke Takahashi, Tokyo (JP); Makoto Sekine, Tokyo (JP)

(73) Assignee: TOK, INC., Tokyo (JP)

( * ) Notice: Subject to any disclaimer, the term of this patent is extended or adjusted under 35 U.S.C. 154(b) by 0 days.

(21) Appl. No.: 16/762,666

(22) PCT Filed: Nov. 8, 2018

(86) PCT No.: PCT/JP2018/041490
§ 371 (c)(1),
(2) Date: May 8, 2020

(87) PCT Pub. No.: WO2019/093421
PCT Pub. Date: May 16, 2019

(65) Prior Publication Data

US 2021/0123282 A1 Apr. 29, 2021

(30) Foreign Application Priority Data

Nov. 10, 2017 (JP) ..... JP2017-217837

(51) Int. Cl.
*E05F 1/08* (2006.01)
*E05F 5/08* (2006.01)
*E05D 15/44* (2006.01)

(52) U.S. Cl.
CPC ..... *E05F 5/08* (2013.01); *E05D 15/44* (2013.01); *E05Y 2201/22* (2013.01);
(Continued)

(58) Field of Classification Search
CPC ... E05F 1/08; E05F 1/10; E05F 1/1041; E05F 1/1091; E05F 1/12; E05F 1/1223;
(Continued)

(56) References Cited

U.S. PATENT DOCUMENTS 1,121,084 A * 12/1914 Finken ..... E05F 3/102 16/62
1,627,113 A * 5/1927 Pearson ..... B60G 15/00 267/224

(Continued)

FOREIGN PATENT DOCUMENTS

DE 19919012 A1 * 11/2000 ..... H01H 9/18
EP 2698547 A2 * 2/2014 ..... F15B 15/226

(Continued)

OTHER PUBLICATIONS

International Search Report issued in corresponding International Application No. PCT/JP2018/041490 with English translation dated Jan. 8, 2019 (4 pages).

(Continued)

*Primary Examiner* — Chuck Y Mah
(74) *Attorney, Agent, or Firm* — Flynn Thiel, P.C.

(57) ABSTRACT

There is provided a hinge arm damper mechanism that reliably achieves a damper effect corresponding to a braking force of an elastic member. The hinge arm damper mechanism is configured to include a pinion gear, a pair of racks and, two sets of heavy load springs and, a pair of slide bars and, and a housing. The housing includes a box-shaped case and a plate-shaped cover. The case accommodates the pinion gear, the pair of racks and, the two sets of heavy load springs and, and the pair of slide bars and. A rotational torque applied to a hinge arm is transmitted to the racks and via a rotational motion of the pinion gear, and is converted into a linear motion of the racks and. The linear motion of the racks and is reliably braked by the respective springs and.

5 Claims, 9 Drawing Sheets

(52) U.S. Cl.
CPC ... *E05Y 2201/474* (2013.01); *E05Y 2201/716* (2013.01); *E05Y 2201/722* (2013.01); *E05Y 2900/148* (2013.01)

(58) Field of Classification Search
CPC ..... E05F 1/1246; E05F 1/1253; E05F 1/1261; E05F 1/1292; E05F 1/14; E05F 3/20; E05F 3/18; E05D 11/1021; E05D 3/12; E05D 3/14; E05D 3/16; E05D 15/40; E05D 15/401; E05D 15/405; E05D 15/406; E05D 15/42; E05D 15/58; E05D 15/565; E06B 3/5045; E05Y 2800/22; E05Y 2900/20; E05Y 2900/202; E05Y 2900/208; E05Y 2900/21; E05Y 2201/21; E05Y 2201/264; E05Y 2201/212; E05Y 2201/604; Y10T 16/5382; Y10T 16/5383; Y10T 16/5384; Y10T 16/53885; Y10T 16/53834
See application file for complete search history.

(56) References Cited

U.S. PATENT DOCUMENTS 1,759,474 A * 5/1930 Volquardsen ..... E05F 1/1261 16/289
1,872,561 A * 8/1932 Franklin ..... E05F 3/08 16/62
1,989,908 A * 2/1935 Bohnsack ..... E05F 1/1253 16/281
2,505,996 A * 5/1950 Simpelaar ..... F23L 13/00 126/285 R
3,746,042 A * 7/1973 Finkel ..... F24F 13/1413 137/601.06
4,369,545 A * 1/1983 Maublanc ..... E05F 3/102 16/64
6,666,306 B2 * 12/2003 Gasser ..... F16F 7/08 16/64
6,681,525 B1 * 1/2004 Dudley ..... E05F 3/102 16/62
7,523,975 B2 * 4/2009 Chaloupka ..... E05F 1/1058 296/37.1
7,578,512 B2 * 8/2009 Runkel ..... B60G 3/14 280/124.128
2006/0174444 A1 * 8/2006 Giovannetti ..... E05D 15/262 16/354
2012/0210540 A1 8/2012 McKibben et al.

FOREIGN PATENT DOCUMENTS

ES 2012171 A6 * 3/1990 ..... F15B 15/226
GB 1214131 A * 12/1970 ..... E05F 3/102
JP S54112537 A 9/1979
JP S60457 Y2 1/1985
JP S60138191 A 7/1985
JP 2000045624 A 2/2000
JP 2012225054 A * 11/2012 ..... E05F 1/16
JP 5844171 B 1/2016
JP 2017066633 A 4/2017
JP 2017095902 A 6/2017

OTHER PUBLICATIONS

Written Opinion of International Searching Authority issued in corresponding International Application No. PCT/JP2018/041490, dated Jan. 8, 2019 (4 pages).

* cited by examiner

HINGE ARM DAMPER MECHANISM

TECHNICAL FIELD

The present invention relates to a hinge arm damper mechanism for buffering a rotational torque applied to a hinge arm.

BACKGROUND ART

In the related art, for example, this type of hinge arm damper mechanisms has been used for inward tilting windows. In the inward tilting window, a window frame and a sash are connected to each other by a hinge arm, and the hinge arm damper mechanism buffers a rotational torque applied to the hinge arm due to a weight of the sash.

For example, in the inward tilting window disclosed in PTL 1, a connection portion including a first arm, a second arm, and a connection shaft configures the hinge arm, and the window frame and the sash are connected to each other by the connection portion. One end of the first arm is connected to the window frame via a first pivot shaft so as to be pivotable forward and rearward. One end of the second arm is connected to the sash via a second pivot shaft so as to be pivotable forward and rearward. The connection shaft connects a lower end of the first arm and a lower end of the second arm to each other so as to be mutually pivotable forward and rearward. In the related art, the hinge arm damper mechanism for this hinge arm is configured so that resin washers or wave washers are interposed to the first pivot shaft, the second pivot shaft, and the connection shaft. The resin washers or the wave washers interposed to the respective shafts generate resistance forces to each pivotal movement of the first pivot shaft, the second pivot shaft, and the connection shaft, and buffer the rotational torque applied to the hinge arm due to the weight of the sash.

CITATION LIST

Patent Literature

[PTL 1] JP-A-2017-66633

SUMMARY OF INVENTION

Technical Problem

However, according to the above-described hinge arm damper mechanism in the related art, when the sash is large and heavy, a damper effect is weakened, and the rotational torque applied to the hinge arm cannot be sufficiently buffered.

Solution to Problem

The present invention is made in order to solve the above-described problem, and aims to provide a hinge arm damper mechanism for buffering a rotational torque applied to a hinge arm by a weight of a mover in an opening and closing device in which the mover opens from a fixed frame due to the weight of the mover.

The mechanism comprises:

a pinion gear disposed by being connected to the other end of the hinge arm which connects between a frame of the fixed frame and a frame of the mover and holds the mover in a state of being tilted at a predetermined angle to the fixed frame while of which one end being attached to the frame of the mover and of which the other end is disposed at a rotation center of the hinge arm;

a rack that is disposed in a pair at positions facing each other across a rotation center of the pinion gear, that moves straight in a direction where the rack move away from each other in response to rotation of the pinion gear, that has an extension portion in a direction intersecting a direction in which the rack moves straight, and that meshes with the pinion gear to convert a rotational motion of the pinion gear into a linear motion;

an elastic member that is disposed in a pair at positions facing each other via each of the rack around the rotation center of the pinion gear, that receives a kinetic force of the rack from the extension portion to one end portion, that brakes the linear motion of the rack; and a housing that comprises a box-shaped case and a plate-shaped cover, that is disposed on a facing surface in the frame of the fixed frame which faces the frame of the mover, that includes a gear support portion for rotatably supporting the pinion gear by shaft portions on both side surfaces of the pinion gear being fitted into an opening portion of the cover and an opening portion of the case, in the shaft portions coaxially with the shaft portions a connection portion that is fitted into the other end of the hinge arm being formed, guide portions for guiding the linear motions of the racks being formed by inner walls of the case which comes into contact with the side surfaces of the racks, and reaction force support portions being configured by end walls of the case for receiving reaction forces generated in the elastic members by braking the linear motions of the racks, and that accommodates the pinion gear, the rack, and the elastic member.

The mechanism characterized in that the mover is held in a state of being opened at a predetermined angle to the fixed frame by a mover opening angle locking mechanism of the opening and closing device that comprises:

a slide rail that is attached on a facing surface in the frame of the mover which faces the frame of the fixed frame, and that has a track and a slide surface extending along a longitudinal direction of the frame of the mover, on the slide surface holes are open at predetermined positions corresponding to a tilting angle of the mover, a slide member that is attached to the slide rail movably along the track, that supports one end of the hinge arm swingably, and that moves in one direction when the mover is opened and one end of the hinge arm swings, a locking member of which one end is pivotably attached to the slide member, that moves the track in the one direction together with the slide member while the other end moves ahead, a second elastic member that is disposed between the slide member and the locking member, that biases the other end of the locking member toward the slide surface and makes the other end of the locking member to come into sliding contact with the slide surface when the slide member moves in the one direction, and that makes the other end of the locking member to engage with the holes, an unlocking member that is attached to the slide rail to be movable along the slide surface, and that moves along the slide surface between an unlocking position where a tip located ahead when the unlocking member moves in the one direction pushes up the other end of the locking member engaging with the hole from the hole and a retreat position where the tip does not push up the other end of the locking member from the hole, a third elastic member that biases the unlocking member to the retreat position along the slide surface.

According to this configuration, the rotational torque applied to the hinge arm is transmitted to the rack via the rotational motion of the pinion gear, and is converted into the linear motion of the rack. The linear motion of the rack is braked by the elastic member. Therefore, the rotational torque applied to the hinge arm is reliably buffered by a braking force of the elastic member. Therefore, the hinge arm damper mechanism having this configuration is applied to the hinge arm of an inward tilting window. In this manner, it is possible to reliably achieve a damper effect corresponding to the braking force of the elastic member. Therefore, even when a sash is large and heavy, a proper damper effect is achieved, and it is possible to buffer the rotational torque applied to the hinge arm of the inward tilting window.

According to this configuration, the braking force of the elastic member is achieved in accordance with a flexible volume of the elastic member. Therefore, when a rotation amount of the hinge arm decreases, a straight moving distance of the rack is shortened, and the flexible volume generated in the elastic member decreases. Accordingly, the braking force of the elastic member is weak, and a force for buffering the rotational torque applied to the hinge arm is weak. On the other hand, when the rotation amount of the hinge arm increases, the distance of the rack moving straight is gradually lengthened, and the flexible volume generated in the elastic member increases. Accordingly, the braking force of the elastic member gradually increases, and the force for buffering the rotational torque applied to the hinge arm gradually increases.

Therefore, the hinge arm damper mechanism having this configuration is applied to a hinge arm of the inward tilting window. In this manner, when an opening amount of the sash is small and the rotation amount of the hinge arm is small, an assisting force for opening and closing operations of the sash is weak. However, as the opening amount of the sash increases and a tilting angle of the sash increases, the rotation amount of the hinge arm increases, and the assisting force for the opening and closing operations of the sash gradually becomes stronger. Therefore, when the sash is opened, an operation force that increases due to a weight of the sash as the sash is opened can be reduced to a lighter operation force by the assisting force of the hinge arm damper mechanism. In addition, when the sash is closed, a biasing force of the elastic member is added to the operation force for closing the sash, and the sash can be closed using the lighter operation force. Therefore, an operator of the sash can perform the opening and closing operations of the sash with a sense of improved operability.

On the other hand, according to the above-described hinge arm damper mechanism in the related art, the damper effect is achieved by the resin washers or the wave washers interposed to the shafts. Accordingly, the damper effect is constant when the sash is opened and closed. Therefore, an operation becomes heavier due to the damper effect of the resin washers and so on when the sash is closed. Accordingly, unlike the hinge arm damper mechanism having this configuration, it is not possible to achieve the sense of improved operability.

According to this configuration, the racks and the elastic members are symmetrically disposed in a pair at positions facing each other around the rotation center of the pinion gear. Accordingly, the rotational motion of the pinion gear is converted into the linear motion of the rack with a satisfactory balance. Therefore, a buffering operation of the hinge arm damper mechanism is stably performed. In addition, a buffering function acts on both sides of the positions facing each other around the rotation center of the pinion gear. Accordingly, a buffering force increases, and it is possible to buffer a strong rotational torque applied to the hinge arm.

According to this configuration, the kinetic force of the rack is stably transmitted to the one end portion of the elastic member via the extension portion. Therefore, the rotational torque applied to the hinge arm is effectively transmitted to the elastic member via the rack, and the braking force of the elastic member effectively acts. In this manner, it is possible to more reliably buffer the rotational torque applied to the hinge arm.

In addition, according to the present invention, a plurality of the elastic members may be disposed in parallel, and each one end portion of the elastic members may share and receive the kinetic force of the rack.

According to this configuration, the braking force achieved by all of the elastic members increases. Accordingly, it is possible to buffer a stronger rotational torque applied to the hinge arm.

In addition, according to the present invention, a reinforcement rib rising in a direction intersecting a linear motion direction of the rack or in a direction parallel to the linear motion direction of the rack may be formed outside a portion where the guide portion of the housing is formed.

The rack converts the rotational motion of the pinion gear into the linear motion under a guidance of the guide portion of the housing. However, a reaction force of restricting the linear motion of the rack is applied to the guide portion, and a force of distorting the housing acts on the guide portion. However, according to this configuration, the reinforcement rib is formed outside the portion where the guide portion of the housing is formed, and the reinforcement rib faces the force of distorting the housing. Therefore, even when the force of distorting the housing is applied to the housing from the rack, the housing is prevented from deforming, and the rotational motion of the pinion gear is reliably converted into the linear motion of the rack.

In addition, according to the present invention, an adjustment member for adjusting an initial braking force of the elastic member may be provided on one end portion side or the other end portion side of the elastic member.

According to this configuration, the initial braking force of the elastic member is adjusted by the adjustment member. In this manner, the buffering force achieved by the hinge arm damper mechanism can be easily set to a desired buffering force. Therefore, it is possible to easily adjust the hinge arm damper mechanism having a required damper effect.

Advantageous Effects of Invention

According to the present invention, it is possible to provide a hinge arm damper mechanism which reliably achieves a damper effect corresponding to a braking force of an elastic member. The hinge arm damper mechanism is applied to a hinge arm of an inward tilting window. In this manner, even when a sash is large and heavy, a rotational torque applied to the hinge arm can be sufficiently buffered.

DESCRIPTION OF EMBODIMENTS

Next, an embodiment in which a hinge arm damper mechanism according to the present invention is applied to an inward tilting window will be described.

Figure 1B:
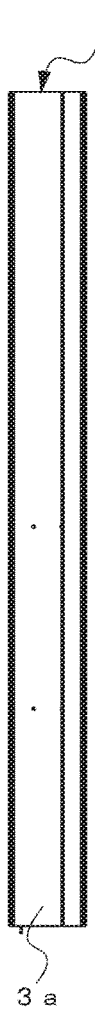
FIG. 1B is a side view.
Figure 1A:
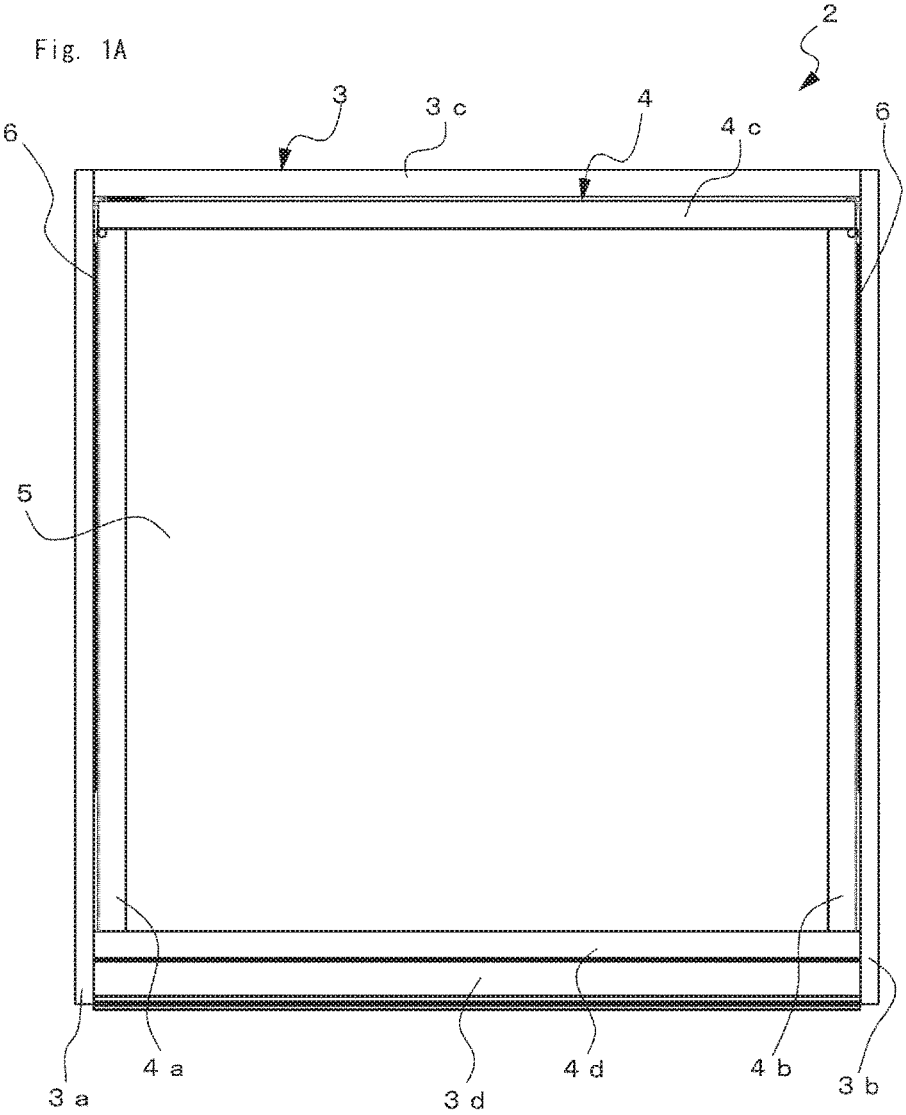
FIG. 1A is a front view of an inward tilting window to which a hinge arm damper mechanism according to an embodiment of the present invention is applied.

FIG. 1A is a front view of an inward tilting window 2 to which hinge arm damper mechanisms 31 and 31 (to be described later) according to the embodiment of the present invention are applied, and FIG. 1B is a side view.

The inward tilting window 2 is configured so that a sash 4 is fitted into a window frame 3. The window frame 3 is configured so that framework is carried out for a left vertical frame 3*a* vertically raised leftward, a right vertical frame 3*b* vertically raised rightward, an upper frame 3*c* for connecting respective upper ends of the left vertical frame 3*a* and the right vertical frame 3*b* to each other, and a lower frame 3*d* for connecting respective lower ends of the left vertical frame 3*a* and the right vertical frame 3*b* to each other. The sash 4 is configured so that framework is carried out for a left vertical frame 4*a* vertically raised leftward, a right vertical frame 4*b* vertically raised rightward, an upper frame 4*c* for connecting respective upper ends of the left vertical frame 4*a* and the right vertical frame 4*b* to each other, and a lower frame 4*d* for connecting respective lower ends of the left vertical frame 4*a* and the right vertical frame 4*b* to each other. The sash 4 has a glass plate 5 interposed among the left vertical frame 4*a*, the right vertical frame 4*b*, the upper frame 4*c*, and the lower frame 4*d*. The window frame 3 and the sash 4 are connected to each other by hinge arms 6 and 6 respectively between the left vertical frame 3*a* and the left vertical frame 4*a*, and between the right vertical frame 3*b* and the right vertical frame 4*b*.

Figure 2:
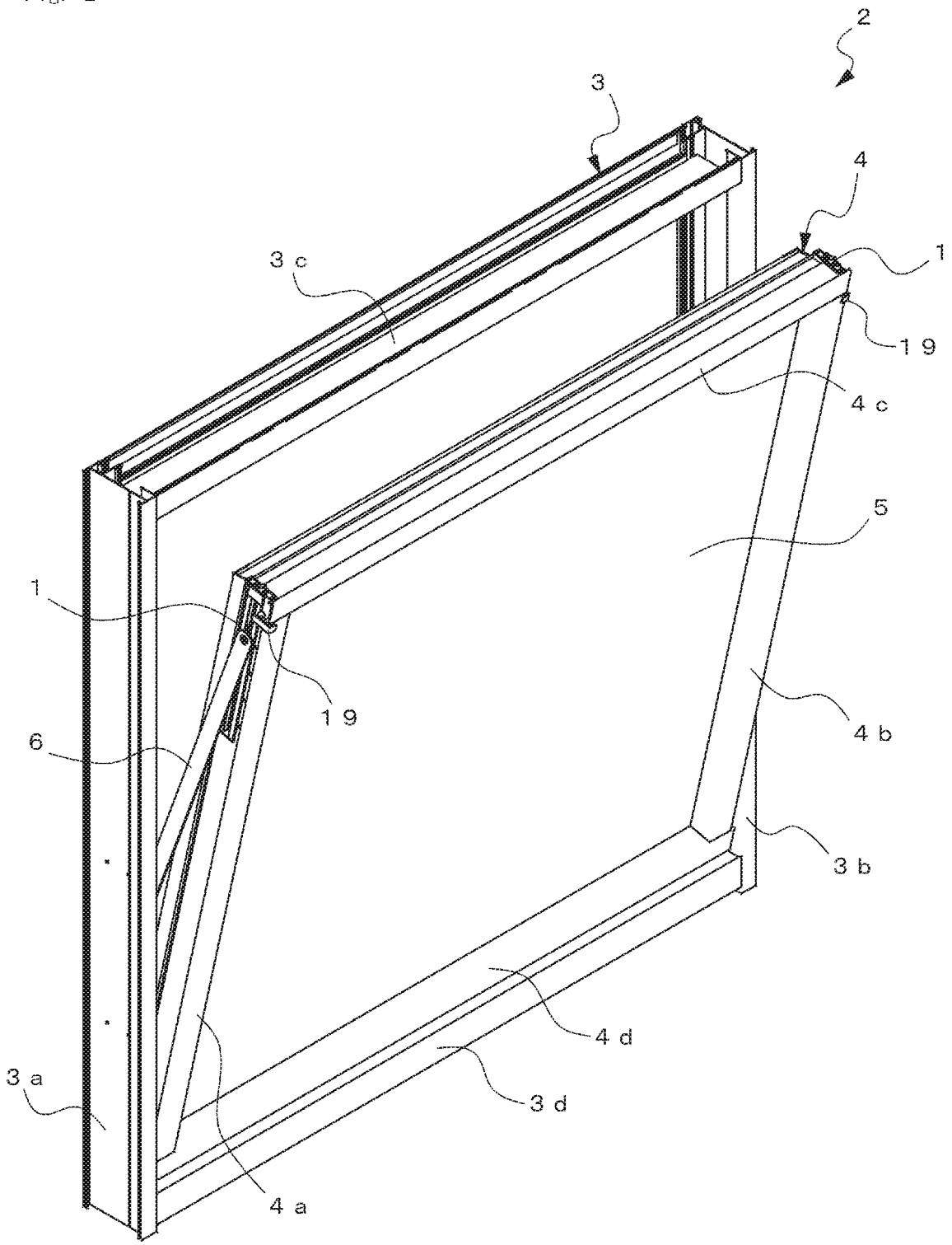
FIG. 2 is a perspective view illustrating a state where a sash is tilted from a window frame in the inward tilting window illustrated in FIG. 1.

FIG. 2 is a perspective view illustrating a half-opened state where the sash 4 is tilted from the window frame 3 while being supported by hinge arms 6 and 6 connecting the window frame 3 and the sash 4 to each other. In the illustration, the same reference numerals will be assigned to the same elements as those in FIG. 1, and description thereof will be omitted.

The upper frame 4*c* side is tilted to an indoor side around a side of the lower frame 4*d* which contacts with the lower frame 3*d*. And then the sash 4 is held in a state of being tilted at a predetermined angle by the sash tilting angle locking mechanisms 1 and 1 connected to each end of the hinge arms 6 and 6. The sash tilting angle locking mechanisms 1 and 1 are disposed on a facing surface in the left vertical frame 4*a* of the sash 4 which faces the left vertical frame 3*a* of the window frame 3, and a facing surface in the right vertical frame 4*b* of the sash 4 which faces the right vertical frame 3*b* of the window frame 3. Each of the sash tilting angle locking mechanisms 1 and 1 has the same configuration. Hereinafter, only one mechanism disposed in the left vertical frame 4*a* of the sash 4 will be described.

Figure 3:
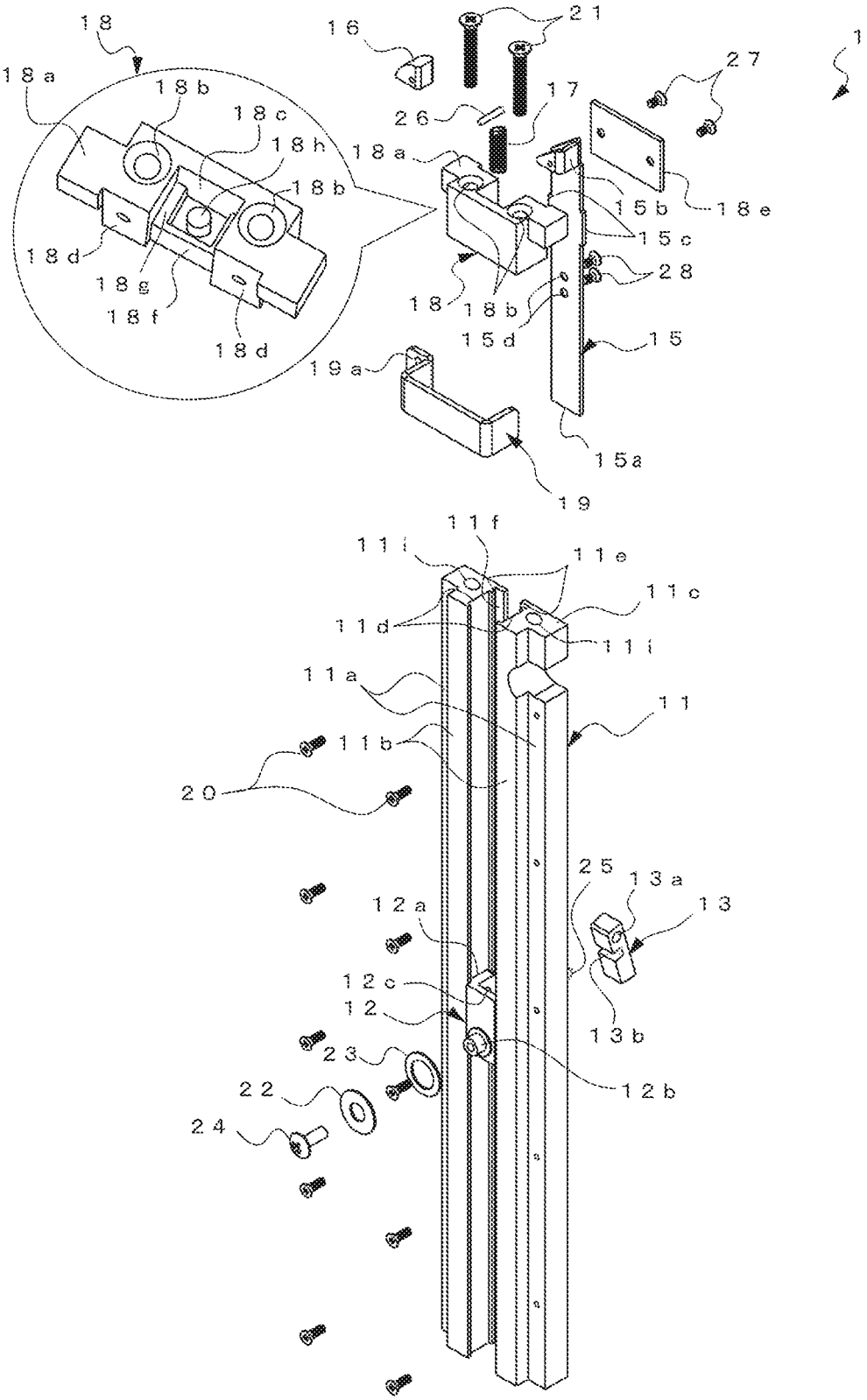
FIG. 3 is an exploded perspective view illustrating a structure of a sash tilting angle locking mechanism used for the inward tilting window illustrated in FIG. 1.
Figure 4A:
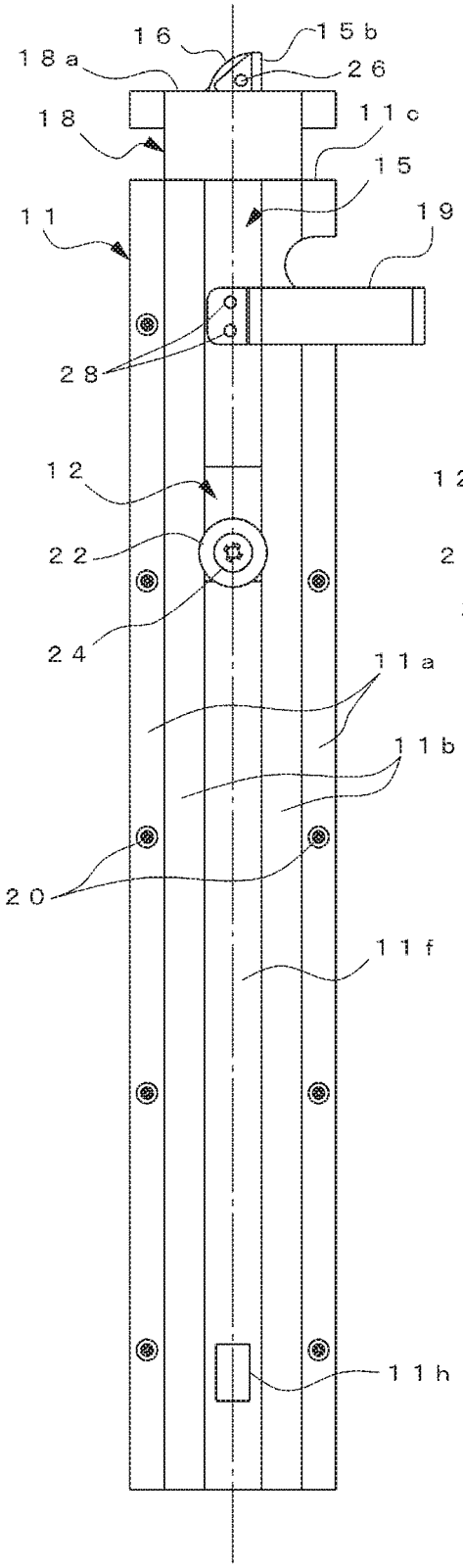
FIG. 4A is a front view illustrating a state where a locking member configuring the sash tilting angle locking mechanism illustrated in FIG. 3 engages with an upper hole.
Figure 4B:
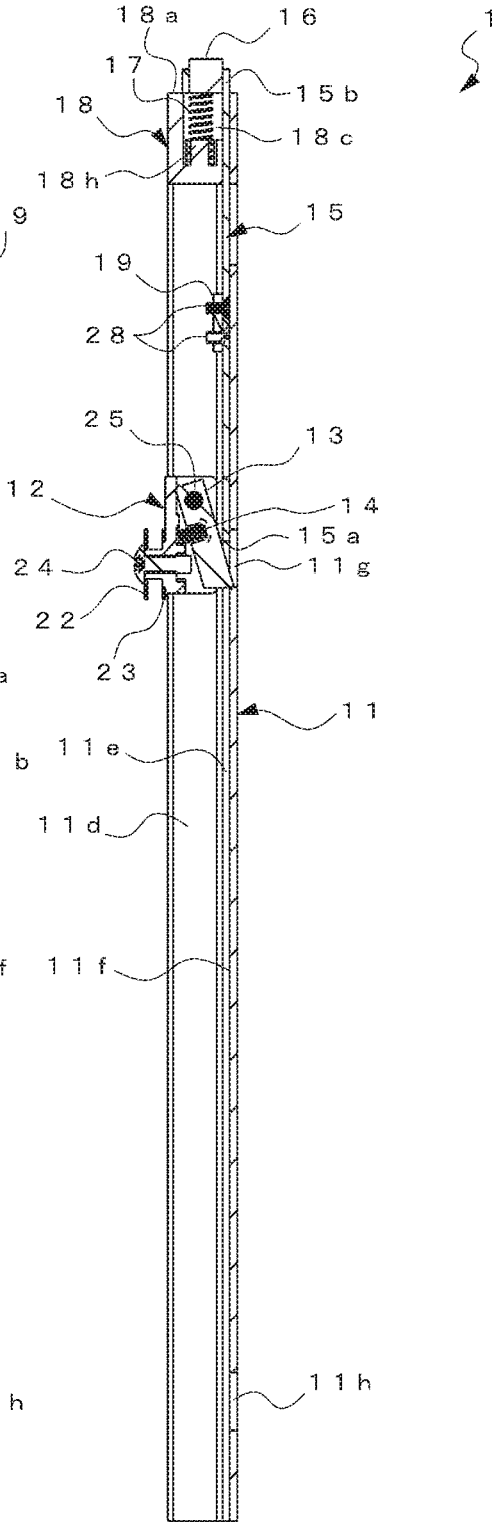
FIG. 4B is a longitudinal sectional view illustrating the state.

FIG. 3 is an exploded perspective view illustrating a structure of the sash tilting angle locking mechanism 1. FIG. 4A is a front view of the sash tilting angle locking mechanism 1, and FIG. 4B is a longitudinal sectional view taken along a center line illustrated in FIG. 4A.

The sash tilting angle locking mechanism 1 is configured to include a slide rail 11, a slide piece 12, a locking member 13, a locking spring 14 (refer to FIG. 4B), an unlocking plate 15, a latch member 16, a latch spring 17, a rail cap 18, and an operation lever 19.

The slide rail 11 is made of an aluminum material, is incorporated in a slit formed on the facing surface in the left vertical frame 4*a* which faces the left vertical frame 3*a*, and is attached to the left vertical frame 4*a*. At this time, a side plates of the left vertical frame 4*a* forming the slit is fastened via five flat head screws 20 to attachment surfaces 11*a* and 11*a* formed one step down from a side of the slide rail 11. Side surfaces 11*b* and 11*b* interposing the slide piece 12 of the slide rail 11 therebetween are flush with a side plate side surface of the left vertical frame 4*a*. In addition, as illustrated in FIGS. 4A and 4B, the rail cap 18 is attached to an end portion 11*c* of the slide rail 11 on the upper frame 4*c* side of the sash 4 by two flat head screws 21 and 21. An upper end surface 18*a* of the rail cap 18 is disposed to be flush with an upper surface of the upper frame 4*c*. The two flat head screws 21 and 21 pass through two through-holes 18*b* and 18*b* formed in the rail cap 18, and are screwed into female screw holes 11*i* and 11*i* formed in the end portion 11*c* of the slide rail 11. The rail cap 18 surrounded by a balloon in FIG. 3 illustrates a state where the original rail cap 18 is obliquely viewed downward from above on a side opposite thereto.

The slide rail 11 has tracks 11*d*, 11*e* and a slide surface 11*f* extending along a longitudinal direction of the left vertical frame 4*a*. The track 11*d* is configured to include a pair of facing grooves facing in a columnar portion forming the side surfaces 11*b* and 11*b* and being formed to have a wide width. The track 11*e* is configured to include a pair of facing grooves formed to have a narrow width. A pair of protruding portions 12*a* and 12*a* protruding on both side portions of the slide piece 12 is fitted into the groove of the track 11*d*. In this manner, the slide piece 12 linearly moves in a formed direction of the track 11*d*. In addition, both side portions of the unlocking plate 15 are fitted into the groove of the track 11*e*. In this manner, the unlocking plate 15 linearly moves along a formed direction of the track 11*e*.

The slide surface 11*f* is formed on a surface facing the left vertical frame 3*a*, in a connection portion connecting the columnar portions forming the side surfaces 11*b* and 11*b*, and is located in the back of the groove forming the tracks 11*d* and 11*e*. On the slide surface 11*f*, holes 11*g* and 11*h* are respectively open at predetermined positions corresponding to a tilting angle of the sash 4. The upper hole 11*g* is open at a position corresponding to a medium tilting angle of the sash 4, and the lower hole 11*h* is open at a position corresponding to a maximum tilting angle of the sash 4.

The slide piece 12 attached to the slide rail 11 movably along the track 11*d* is formed by means of aluminum die casting, and configures a slide member. The slide piece 12 swingably supports one end of the hinge arm 6 on the sash 4 side in a shaft portion 12*b* formed to protrude in a cylindrical shape on the side surface of the slide piece 12. One end of the hinge arm 6 is interposed between resin washers 22 and 23, and a hole formed in one end thereof passes through the shaft portion 12*b* together with the resin washers 22 and 23. Then, a truss screw 24 is screwed into a female screw formed in the shaft portion 12*b*, and one end of the hinge arm 6 is prevented from slipping from the shaft portion 12*b* together with the resin washers 22 and 23. In this manner, one end of the hinge arm 6 is swingably supported by the shaft portion 12*b*. When the sash 4 is opened, one end of the hinge arm 6 swings due to the own weight of the hinge arm 6. In this manner, the slide piece 12 moves in one direction away from the end portion 11*c* of the track 11*d*.

The slide piece 12 has a cavity on a side facing the slide surface 11*f*, and the locking member 13 is accommodated in the cavity. The locking member 13 is molded by means of aluminum die casting as in the slide piece 12. In the locking member 13, a pin 25 passes through a through-hole 13*a* formed in one end of the locking member 13. Both ends of the pin 25 are supported by a pair of holes 12*c* and 12*c* formed to face in an upper end side of the slide piece 12. One end of the locking member 13 is pivotably attached to the slide piece 12. In the locking member 13, one end is pivotably attached to the slide piece 12 in this way. Accordingly, while the other end moves ahead, the locking member 13 moves the track 11*d* in one direction together with the slide piece 12.

A locking spring 14 is disposed between the slide piece 12 and the locking member 13. One end portion of the locking spring 14 is fitted into a groove 13*b* disposed in an abdomen portion of the locking member 13, and biases the other end of the locking member 13 toward the slide surface 11*f*. Since the other end of the locking member 13 is biased, the other end of the locking member 13 comes into sliding contact with the slide surface 11*f* when the slide piece 12 moves in one direction, and engages with the holes 11*g* and 11*h* formed on the slide surface 11*f*. The other end of the locking member 13 is tilted so that an angle formed by coming into contact with the slide surface 11*f* is an acute angle. A plurality of the holes 11*g* and 11*h* are formed on the slide surface 11*f* along a sliding direction in accordance with a plurality of tilting angles of the sash 4.

Figure 5A:
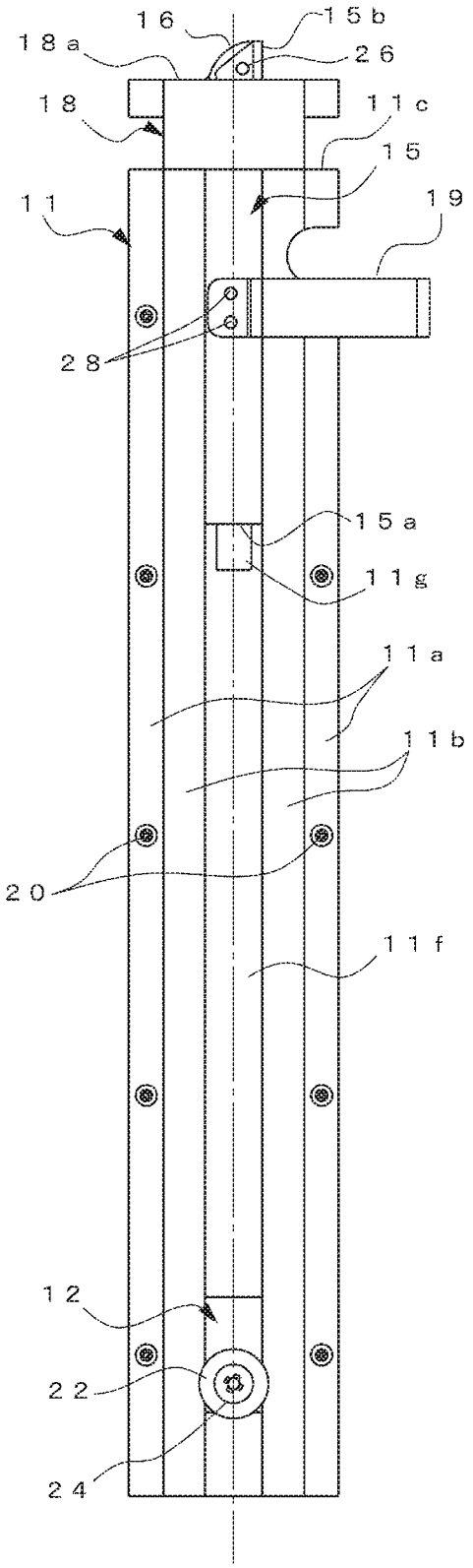
FIG. 5A is a front view illustrating a state where the locking member configuring the sash tilting angle locking mechanism illustrated in FIG. 3 engages with a lower hole.
Figure 5B:
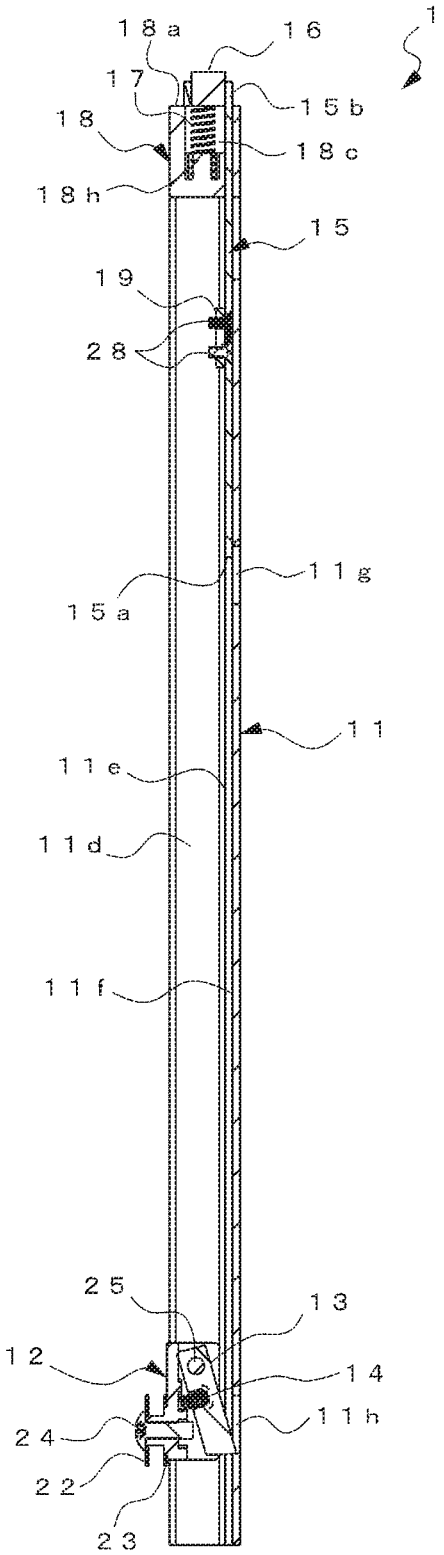
FIG. 5B is a longitudinal sectional view illustrating the state.

FIGS. 4A and 4B illustrate a state where the other end of the locking member 13 engages with the upper hole 11*g*, and FIGS. 5A and 5B illustrate a state where the other end of the locking member 13 engages with the lower hole 11*h*. FIG. 5A is a front view of the sash tilting angle locking mechanism 1 in this case, and FIG. 5B is a longitudinal sectional view taken along a center line illustrated in FIG. 5A. The same reference numerals are assigned to elements the same as those in FIGS. 4A and 4B.

Figure 6A:
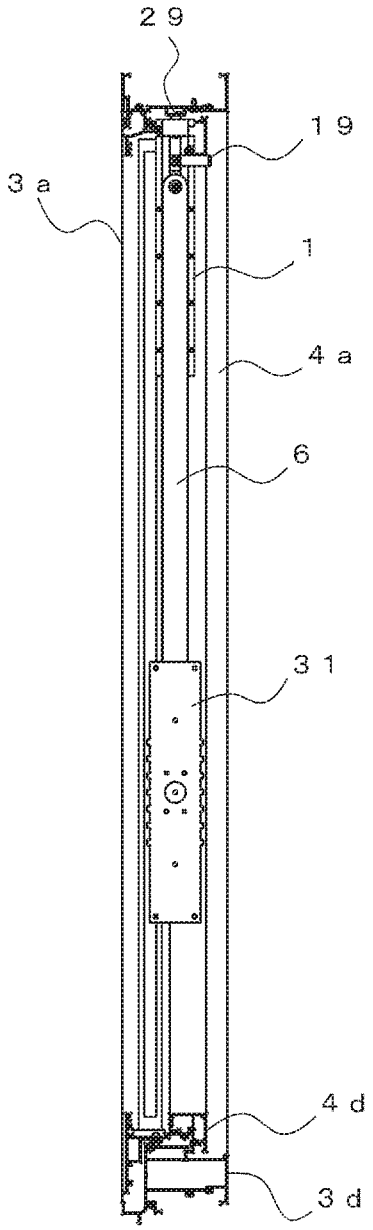
FIG. 6A is a side view of the inward tilting window in a state where the window frame is closed with the sash by the sash tilting angle locking mechanism illustrated in FIG. 3.
Figure 6B:
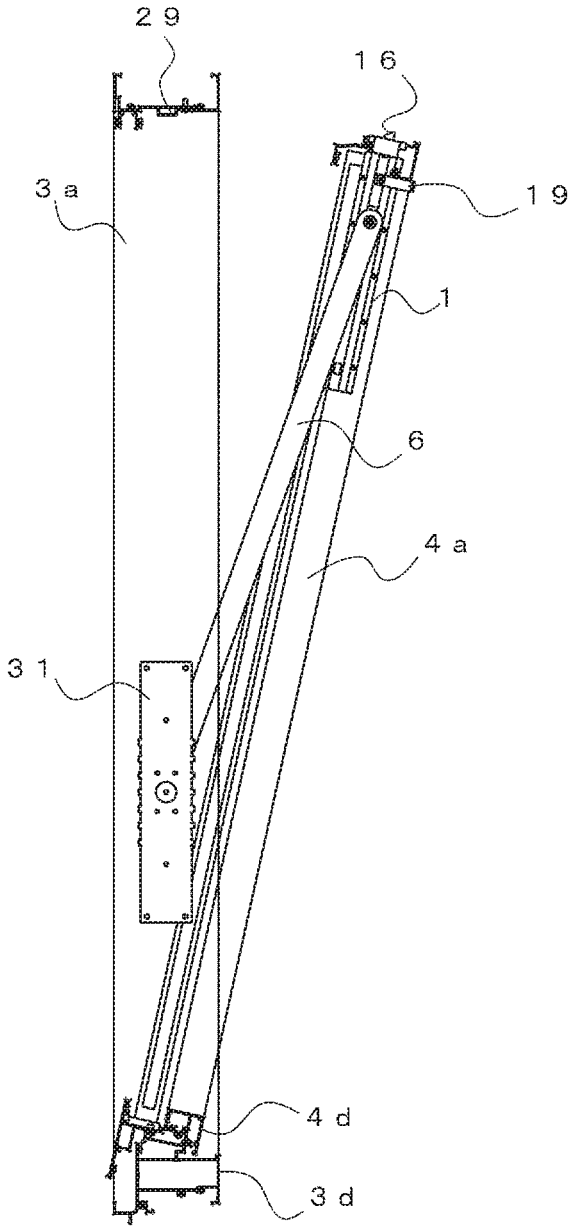
FIG. 6B is a side view of the inward tilting window in a half-opened state where the sash is tilted at an intermediate angle.
Figure 7:
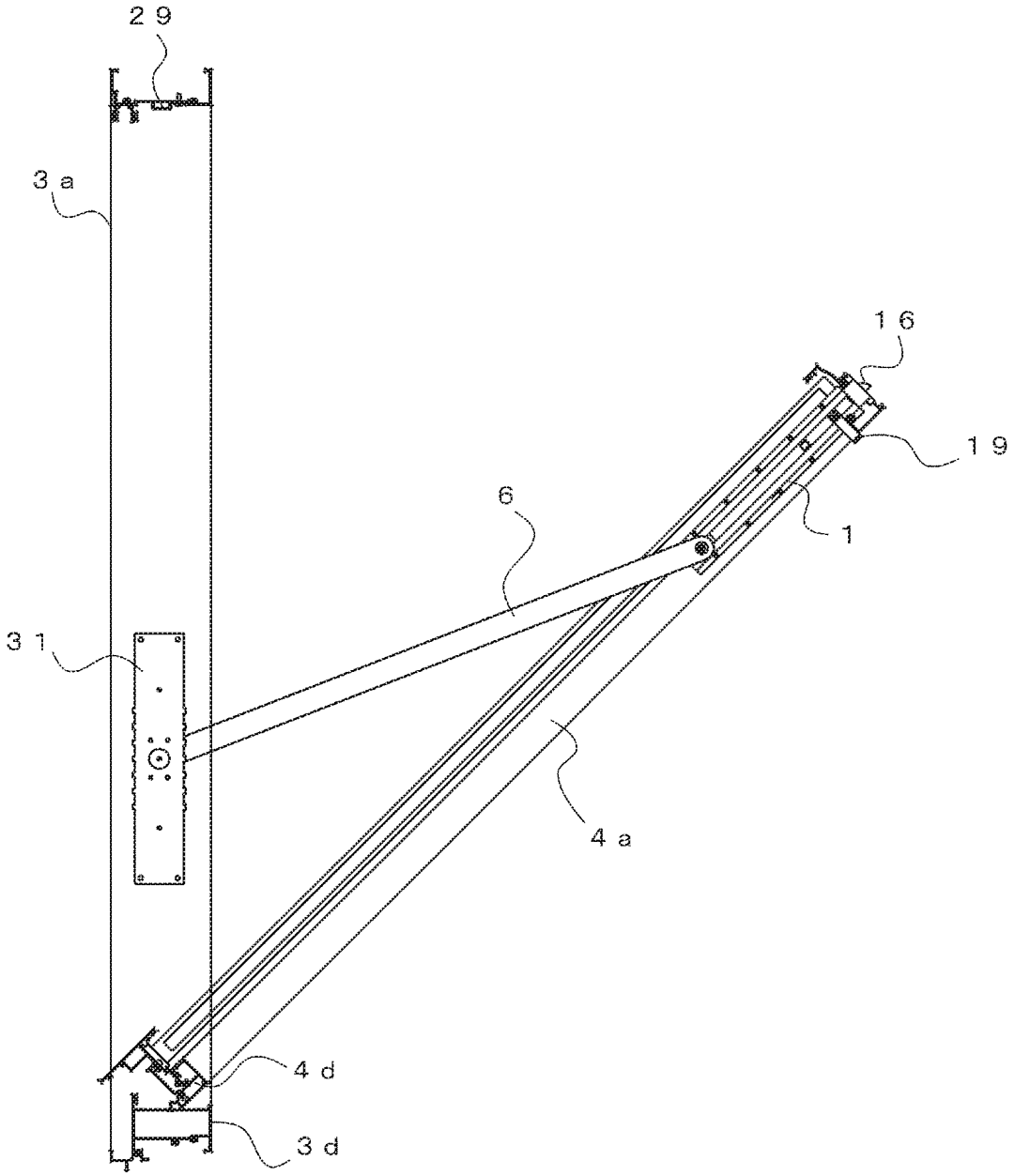
FIG. 7 is a side view of the inward tilting window in a fully open state where the sash is tilted at a maximum angle by the sash tilting angle locking mechanism illustrated in FIG. 3.

In the present embodiment, as described above, the other end of the locking member 13 engages with the holes 11*g* and 11*h* at a plurality of locations on the slide surface 11*f*, and the slide piece 12 is locked at a plurality of locations in the track 11*d*. Accordingly, as illustrated in FIGS. 6A, 6B, and a side view in FIG. 7, one end of the hinge arm 6 is held in multiple stages at a plurality of angles. FIG. 6A illustrates a state where the hinge arm 6 is raised and the window frame 3 is closed by the sash 4. FIG. 6B illustrates a state where the hinge arm 6 is tilted at an intermediate angle and the sash 4 is half-opened. FIG. 7 illustrates a state where the hinge arm 6 is tilted at a maximum angle and the sash 4 is fully opened. In this way, the sash 4 is held at the plurality of tilting angles by the hinge arm 6, and is tilted in multiple stages. Accordingly, it is possible to select a plurality of opening degrees of the inward tilting window 2.

The unlocking plate 15 is made of a stainless steel plate, is guided by the track 11*e*, and is attached to the slide rail 11 to be movable along the slide surface 11*f*. The unlocking plate 15 moves along the slide surface 11*f* between an unlocking position and a retreat position. The unlock position is an operating position where a tip 15*a* located ahead when the unlocking plate 15 moves in one direction pushes up the other end of the locking member 13 engaging with the hole 11*g* from the hole 11*g*. The retreat position is an initial position where the tip 15*a* does not push up the other end of the locking member 13 from the hole 11*g*. FIGS. 4A, 4B and 5A, 5B illustrate a state where the unlocking plate 15 is located at the retreat position. The latch spring 17 biases the unlocking plate 15 to the retreat position along the slide surface 11*f*. When the unlocking plate 15 is located at the retreat position, a rear end 15*b* thereof is disposed to protrude from the rail cap 18 as illustrated in FIGS. 4A, 4B and 5A, 5B.

As illustrated in FIG. 3, the unlocking plate 15 has a bent portion formed by bending the rear end 15*b*. A pin 26 passes through a pair of holes formed in the bent portion and a through-hole formed in the resin-made latch member 16. The latch member 16 is attached to the rear end 15*b* while being interposed between the bent portions. The rear end 15*b* to which the latch member 16 is attached is accommodated in a rectangular space 18*c* formed in the resin-made rail cap 18 to be retractable, and side surfaces 18*d* and 18*d* are closed by a latch cover 18*e*. The latch cover 18*e* is attached to the side surfaces 18*d* and 18*d* by a pair of flat head screws 27 and 27. In addition, a slide groove 18*f* is formed between blocks forming the side surfaces 18*d* and 18*d*, and a portion directly below the rear end 15*b* of the unlocking plate 15 is fitted into the slide groove 18*f*, thereby guiding the movement of the unlocking plate 15.

The bent portion formed in the rear end 15*b* of the unlocking plate 15 forms a first protruding portion. When the unlocking plate 15 moves downward, the bent portion comes into contact with a rectangular surface 18*g* formed in the space 18*c*. The surface 18*g* comes into contact with the first protruding portion disposed in the rear end 15*b* of the unlocking plate 15, thereby configuring a surface for determining the unlocking position of the unlocking plate 15. In addition, as a second protruding portion, the abdomen portion of the unlocking plate 15 has protruding portions 15*c* and 15*c* protruding on both sides. When the unlocking plate 15 moves upward, the protruding portions 15*c* and 15*c* come into contact with a bottom surface of the rail cap 18. The bottom surface of the rail cap 18 configures a surface for determining the retreat position of the unlocking plate 15 by coming into contact with the second protruding portions.

The unlocking plate 15 is guided by the slide groove 18*f* formed in the rail cap 18 and the track 11*e* formed in the slide rail 11, and moves the slide surface 11*f*. The unlocking plate 15 has a length so that the tip 15*a* reaches the hole 11*g* located one step closer than the farthest hole 11*h* out of the holes 11*g* and 11*h*. The movement in one direction of the unlocking plate 15 against the biasing force of the latch spring 17 is stopped at the unlocking position as follows. The bent portion disposed in the rear end 15*b* of the unlocking plate 15 comes into contact with the surface 18*g* of the rail cap 18 for determining the unlocking position of the unlocking plate 15. At the unlocking position of the unlocking plate 15, the tip 15*a* pushes up the other end of the locking member 13 engaging with the hole 11*g* from the hole 11*g* of the slide surface 11*f*. In this manner, the other end of the locking member 13 disengages from the hole 11*g*. In addition, the movement in a direction opposite to the one direction of the unlocking plate 15 is stopped at the retreat position as follows. The protruding portions 15*c* and 15*c* of the unlocking plate 15 come into contact with the bottom surface of the rail cap 18 for determining the retreat position of the unlocking plate 15. The unlocking plate 15 is held at the retreat position by the biasing force of the latch spring 17.

The bottom surface of the space 18*c* formed in the rail cap 18 has a columnar support portion 18*h* fitted into one end of the latch spring 17 to support the one end. The other end of the latch spring 17 comes into contact with the bottom surface of the latch member 16, and an elastic force thereof causes the latch member 16 to protrude from the upper end surface 18*a* of the rail cap 18, that is, the upper surface of the upper frame 4*c* of the sash 4.

As illustrated in FIGS. 4A, 4B and 5A, 5B, the latch member 16 protrudes from an outer shape of the rear end 15*b* of the unlocking plate 15. An outdoor side surface thereof is curved, and is disposed in the rear end 15*b* of the unlocking plate 15. The latch member 16 is biased in a protruding direction from the upper frame 4*c* of the sash 4 by the biasing force of the latch spring 17. When the sash 4 is closed, the outdoor side surface is pushed by coming into contact with the upper frame 3*c* of the window frame 3. The outdoor side surface falls to the upper frame 4*c* side of the sash 4, and is accommodated in the space 18*c* formed in the rail cap 18 together with the latch spring 17. Thereafter, when the sash 4 is closed and the latch member 16 reaches a latch receiver 29 (refer to FIGS. 6A and 6B) configuring an engaging target portion formed in the upper frame 3*c* of the window frame 3, the latch member 16 protrudes from the upper frame 4*c* of the sash 4 due to the biasing force of the latch spring 17, and engages with the latch receiver 29 as illustrated in FIG. 6A.

Two holes 15*d* and 15*d* are formed below the protruding portions 15*c* and 15*c* formed in the unlocking plate 15. Two flat head screws 28 and 28 pass through the holes 15*d* and 15*d*, and the flat head screws 28 and 28 are screwed into two female screw holes 19*a* and 19*a* formed in an end portion of the operation lever 19. In this manner, the end portion of the operation lever 19 is fixed to the unlocking plate 15. The operation lever 19 is formed by bending a stainless steel plate, and disposed to extend to the indoor side from the unlocking plate 15 as illustrated in FIG. 2. The operation lever 19 configures an unlocking operation member that moves the unlocking plate 15 to the unlocking position along the slide surface 11*f* against the biasing force of the latch spring 17. The latch member 16 does not disengage from the latch receiver 29 if the latch member 16 does not fall to the upper frame 4*c* side of the sash 4 after the operation lever 19 is operated in one direction against the biasing force of the latch spring 17. Therefore, the latch member 16 engages with the latch receiver 29. In this manner, the window frame 3 is held in a state of being closed by the sash 4.

In the sash tilting angle locking mechanism 1 configured in this way, when the sash 4 is opened, one end of the hinge arm 6 swings due to the own weight, and the slide piece 12 swingably supporting one end of the hinge arm 6 moves the track 11*d* of the slide rail 11 in one downward direction. At this time, the locking member 13 whose one end is pivotably attached to the slide piece 12 is biased toward the slide surface 11*f* of the slide rail 11 by the locking spring 14, and comes into sliding contact with the slide surface 11*f*. When the sash 4 is tilted at a predetermined angle, the other end of the locking member 13 is fitted into the holes 11*g* and 11*h* which are open on the slide surface 11*f*, and engages with the holes 11*g* and 11*h*. Accordingly, the movement of the slide piece 12 in one direction is prevented. As illustrated in FIGS. 6A, 6B and 7, the hinge arm 6 whose one end is supported by the slide piece 12 is held at a position where the movement of the slide piece 12 is prevented. The sash 4 supported by the hinge arm 6 is held in a state of being tilted at a predetermined angle.

The unlocking plate 15 is always biased by the latch spring 17, and is held at the retreat position where the tip 15*a* located ahead when moving in one direction does not reach the hole 11*g*. In a state where the sash 4 is tilted at a predetermined angle as illustrated in FIG. 6B, when the operation lever 19 is operated and the unlocking plate 15 is moved in one direction along the slide surface 11*f* against the biasing force of the latch spring 17, the tip 15*a* of the unlocking plate 15 reaches the hole 11*g* located one step closer than the farthest hole 11*h* out of the holes 11*g* and 11*h*. Then, the tip 15*a* of the unlocking plate 15 pushes up the other end of the locking member 13 from the hole 11*g*. An engagement state between the hole 11*g* out of the plurality of holes 11*g* and 11*h* formed on the slide surface 11*f* except for the hole 11*h* farthest from the unlocking plate 15 and the other end of the locking member 13 can be released by the tip 15*a* of the unlocking plate 15 in this way.

In the present embodiment, a case has been described where the slide surface 11*f* has the two holes 11*g* and 11*h*. However, even in a case where the slide surface 11*f* between the holes 11*g* and 11*h* further has three or more holes (not illustrated), an engagement state between the respective holes and the other end of the locking member 13 is released in the following order by the tip 15*a* of the unlocking plate 15. The order is determined in order away from the unlocking plate 15 located at the retreat position, from the hole 11*g* located closest to the unlocking plate 15 at the retreat position to the hole located one step closer than the farthest hole 11*h*. Therefore, the sash 4 is in a state where the tilting angle illustrated in FIG. 7 is maximized. The tilting angle is determined by a position of the slide piece 12 where the farthest hole 11*h* and the other end of the locking member 13 engage with each other. An engagement state between the farthest hole 11*h* and the other end of the locking member 13 is released as follows. The tilted sash 4 is raised, and one end of the hinge arm 6 is swung in the opposite direction. The slide piece 12 slides along the slide surface 11*f* in the direction opposite to the one direction. The other end of the locking member 13 slides on the farthest hole 11*h*. Thereafter, the tilted sash 4 is further raised. In this manner, one end of the hinge arm 6 further swings in the opposite direction. In response thereto, the slide piece 12 slides in the opposite direction. Accordingly, the other end of the locking member 13 slides on respective holes, sequentially up to the hole 11*g* located at the closest position. Then, finally, the sash 4 is raised, and the tilted window is brought into a closed state as illustrated in FIG. 6A.

In addition, the other end of one hinge arm 6 is connected to the hinge arm damper mechanism 31 illustrated in FIGS. 6A, 6B and 7 which is disposed on a surface in the left vertical frame 3*a* of the window frame 3 which faces the left vertical frame 4*a* of the sash 4. The other end of the other hinge arm 6 is connected to the similar hinge arm damper mechanism 31 disposed on a surface in the right vertical frame 3*b* of the window frame 3 which faces the right vertical frame 4*b* of the sash 4. In the respective hinge arms 6 and 6, the rotational torque applied to the hinge arms 6 and 6 is buffered by the hinge arm damper mechanisms 31 and 31.

Figure 8:
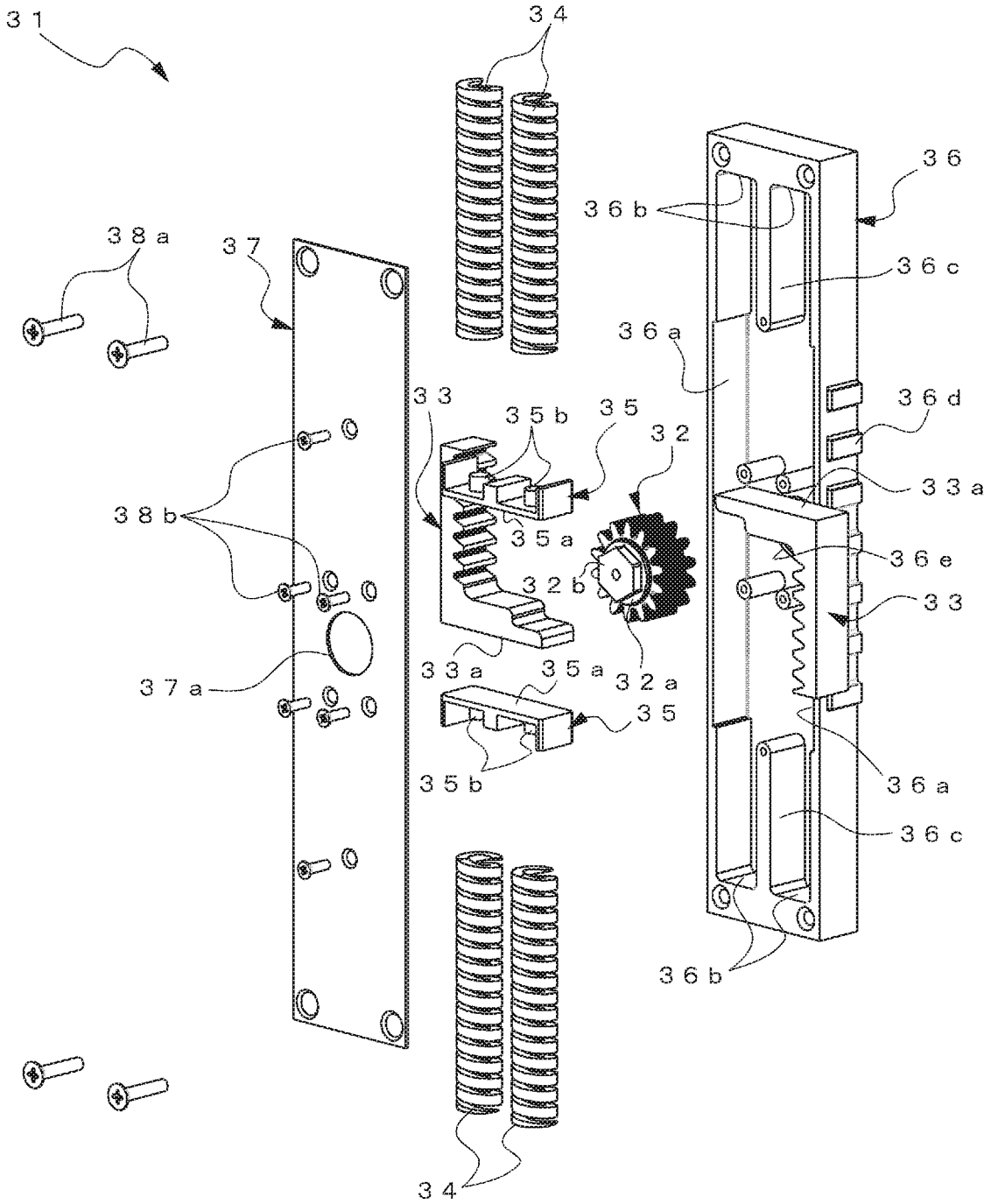
FIG. 8 is an exploded perspective view illustrating a structure of the hinge arm damper mechanism according to the embodiment.
Figure 9A:
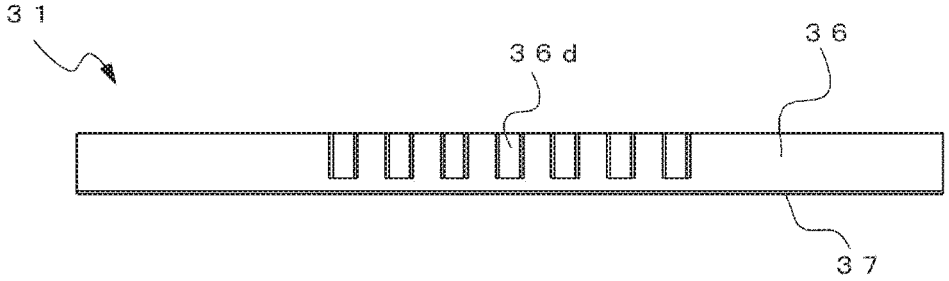
FIG. 9A is a side view of the hinge arm damper mechanism illustrated in FIG. 8.
Figure 9B:
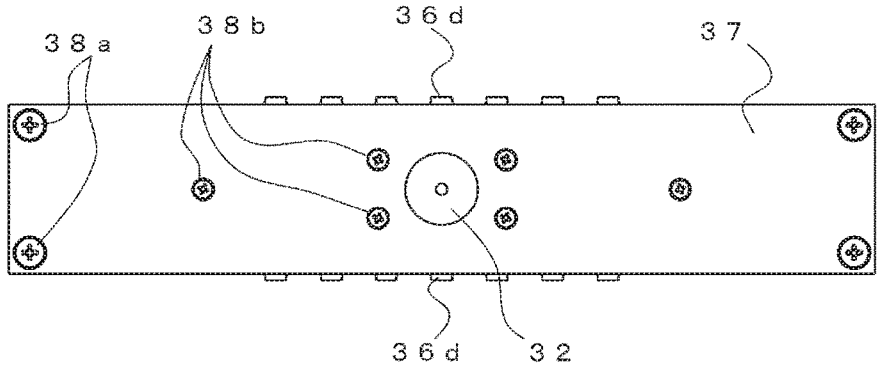
FIG. 9B is a plan view.
Figure 9C:
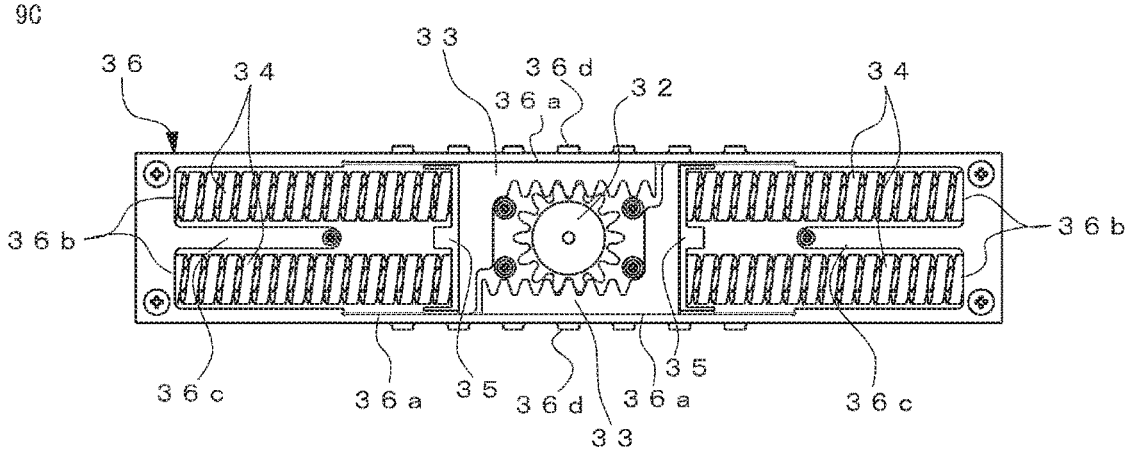
FIG. 9C is a plan view illustrating an arrangement of respective components in a state before the hinge arm damper mechanism is operated.
Figure 9D:
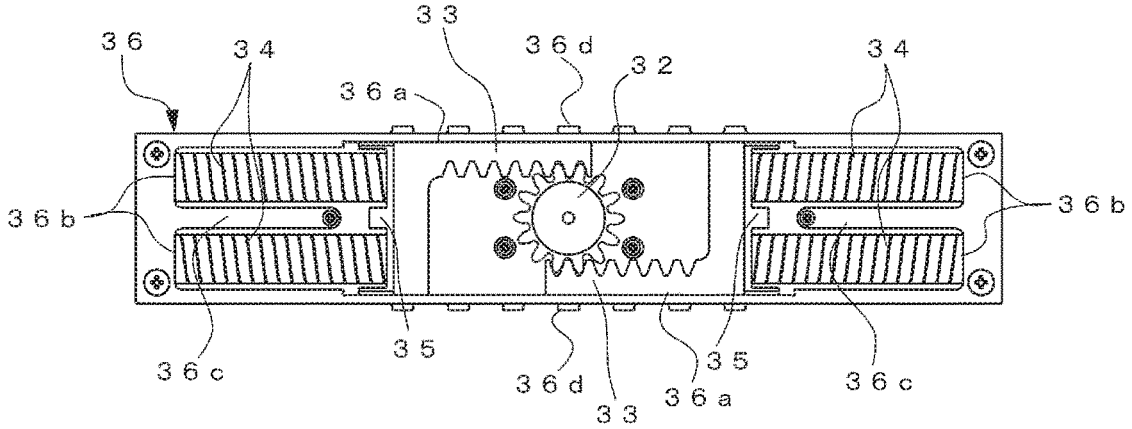
FIG. 9D is a plan view illustrating the arrangement of the respective components in a state when the hinge arm damper mechanism is operated.

FIG. 8 is an exploded perspective view of the hinge arm damper mechanism 31. FIG. 9A is a side view of the hinge arm damper mechanism 31. FIG. 9B is a plan view. FIG. 9C is a plan view illustrating an arrangement of respective components in a state before the hinge arm damper mechanism 31 is operated. FIG. 9D is a plan view illustrating an arrangement of the respective components in a state when the hinge arm damper mechanism 31 is operated.

The hinge arm damper mechanism 31 is configured to include a pinion gear 32, a pair of racks 33 and 33, two sets of heavy load springs 34 and 34, a pair of slide bars 35 and 35, and a housing. The housing includes a box-shaped case 36 and a plate-shaped cover 37. As illustrated in FIGS. 9C and 9D, the case 36 accommodates the pinion gear 32, the pair of racks 33 and 33, the two sets of heavy load springs 34 and 34, and the pair of slide bars 35 and 35. The cover 37 is attached to the case 36 which accommodates the respective components by large flat head screws 38*a* and small flat head screws 38*b*. The respective components are sealed as illustrated in FIGS. 9A and 9B.

Shaft portions 32*a* on both side surfaces of the pinion gear 32 are fitted into an opening portion 37*a* of the cover 37 and an opening portion 36*e* of the case 36. In this manner, the pinion gear 32 is rotatably supported by the housing. The opening portion 37*a* and the opening portion 36*e* configure a gear support portion. A hexagonal column-shaped connection portion 32*b* is formed coaxially with the shaft portion 32*a* in the shaft portion 32*a* on the side surface on the cover 37 side. The other end of the hinge arm 6 is fitted into the connection portion 32*b*, and the hinge arm 6 rotates around the other end.

The pair of racks 33 and 33 is disposed at positions facing each other across a rotation center of the pinion gear 32, and linearly moves in a direction where the racks 33 and 33 move away from each other in response to the rotation of the pinion gear 32. The racks 33 and 33 mesh with the pinion gear 32, and convert a rotational motion of the pinion gear 32 into a linear motion. In the case 36, guide portions 36*a* and 36*a* for guiding the linear motion of the racks 33 and 33 are formed by an inner wall of the case 36 which comes into contact with the side surface of the racks 33 and 33. A plurality of reinforcement ribs 36*d* bulging in a direction intersecting a linear motion direction of the racks 33 and 33 are formed on an outer portion of the case 36 in a portion having the guide portions 36*a* and 36*a*.

The racks 33 and 33 respectively have extension portions 33*a* and 33*a* in a direction intersecting a straight moving direction. Slide bars 35 and springs 34 and 34 are accommodated between the respective extension portions 33*a* and 33*a* and end walls 36*b* and 36*b* of the case 36. In each of the slide bars 35, a contact surface 35*a* that is formed in parallel with the extension portion 33*a* and comes into contact with the extension portion 33*a* is formed on the rack 33 side. In addition, fitting portions 35*b* and 35*b* fitted to one end portion of the respective springs 34 and 34 are aligned on the springs 34 and 34 side. Each of the slide bars 35 configures a restriction member disposed between the extension portion 33*a* and the one end portion of the respective springs 34 and 34.

Each set of the springs 34 and 34 is disposed as a pair at facing positions via the respective racks 33 and 33 around the rotation center of the pinion gear 32. The springs 34 and 34 are formed using compression coil springs, and configure elastic members that brake the linear motion of the respective racks 33 and 33 in a direction where the racks 33 and 33 move away from each other. The respective springs 34 and 34 receive a kinetic force of the rack 33 which is applied to one end portion from the extension portion 33*a* via the slide bar 35. The end wall 36*b* of the case 36 configures a reaction force support portion, and receives a reaction force generated in the springs 34 and 34 by braking the linear motion of the rack 33. In the present embodiment, two springs 34 are disposed in parallel with each other, and each one end portion of the springs 34 and 34 shares and receives the kinetic force of the rack 33. The springs 34 and 34 are separated by a partition wall 36*c* of the case 36, thereby preventing buckling.

According to the hinge arm damper mechanism 31 in the present embodiment, the rotational torque applied to the hinge arm 6 is transmitted to the racks 33 and 33 via the rotational motion of the pinion gear 32, and is converted into the linear motion of the racks 33 and 33. This linear motion of the racks 33 and 33 is braked by the respective springs 34 and 34. Therefore, the rotational torque applied to the hinge arm 6 is reliably buffered by a braking force of the springs 34 and 34. Therefore, the hinge arm damper mechanism 31 having this configuration is applied to the hinge arm 6 of the inward tilting window 2. In this manner, it is possible to reliably achieve a damper effect corresponding to the braking force of the springs 34 and 34. Therefore, even when the sash 4 is large and heavy, a proper damper effect is achieved, and the rotational torque applied to the hinge arm 6 of the inward tilting window 2 can be sufficiently buffered.

In addition, according to the hinge arm damper mechanism 31 in the present embodiment, the braking force of the springs 34 and 34 is achieved in accordance with a flexible volume thereof. Therefore, as illustrated in FIG. 6B, when the rotation amount of the hinge arm 6 decreases, a straight moving distance of the racks 33 and 33 is shortened, and the flexible volume generated in the springs 34 and 34 decreases. Accordingly, the braking force of the springs 34 and 34 is weak, and the force for buffering the rotational torque applied to the hinge arm 6 is weak. On the other hand, when the rotation amount of the hinge arm 6 increases to the maximum tilting angle of the sash 4 illustrated in FIG. 7, the straight moving distance of the racks 33 and 33 is gradually lengthened, and the flexible volume generated in the springs 34 and 34 increases. Accordingly, the braking force of the springs 34 and 34 gradually increases, and the force for buffering the rotational torque applied to the hinge arm 6 gradually increases.

Therefore, the hinge arm damper mechanism 31 according to the present embodiment is applied to the hinge arm 6 of the inward tilting window 2. In this manner, when the opening amount of the sash 4 is small and the rotation amount of the hinge arm 6 is small, an assisting force for the opening and closing operations of the sash 4 is weak. However, as the opening amount of the sash 4 increases and the tilting angle of the sash 4 increases, the rotation amount of the hinge arm increases. Accordingly, the assisting force for the opening and closing operations of the sash 4 gradually increases. Therefore, when the sash 4 is opened, the operation force that increases due to the weight of the sash 4 as the sash 4 is opened can be reduced to a lighter operation force by the assisting force of the hinge arm damper mechanism 31. In addition, when the sash 4 is closed, the biasing force of the springs 34 and 34 is added to the operation force for closing the sash 4. Accordingly, the sash 4 can be closed with the lighter operation force. Therefore, an operator of the sash 4 can perform the opening and closing operations of the sash 4 with a sense of improved operability.

On the other hand, according to the above-described hinge arm damper mechanism in the related art, the damper effect is achieved by the resin washers or the wave washers interposed to the shafts. Accordingly, the damper effect is constant when the sash 4 is opened and closed. Therefore, the operation becomes heavier due to the damper effect of the resin washers and so on when the sash 4 is closed. Accordingly, unlike the hinge arm damper mechanism 31 according to the present embodiment, it is not possible to achieve the sense of improved operability.

In addition, according to the hinge arm damper mechanism 31 in the present embodiment, the racks 33 and 33 and the springs 34 and 34 are symmetrically disposed in a pair at positions facing each other around the rotation center of the pinion gear 32. Accordingly, the rotational motion of the pinion gear 32 is converted into the linear motion of the racks 33 and 33 with a satisfactory balance. Therefore, the buffering operation of the hinge arm damper mechanism 31 is stably performed. In addition, a buffering function acts on both sides of the positions facing each other around the rotation center of the pinion gear 32. Accordingly, a buffering force increases, and it is possible to buffer a strong rotational torque applied to the hinge arm 6.

In addition, according to the hinge arm damper mechanism 31 in the present embodiment, the kinetic force of the racks 33 and 33 is stably transmitted to the one end portion of the springs 34 and 34 via the extension portions 33*a* and 33*a*. Therefore, the rotational torque applied to the hinge arm 6 is effectively transmitted to the springs 34 and 34 via the racks 33 and 33, and the braking force of the springs 34 and 34 effectively acts on the racks 33 and 33. Accordingly, it is possible to more effectively buffer the rotational torque applied to the hinge arm 6.

In addition, according to the hinge arm damper mechanism 31 in the present embodiment, two springs 34 and 34 are disposed in parallel with each other, and the braking force achieved by all of the springs 34 and 34 increases. Accordingly, it is possible to buffer the stronger rotational torque applied to the hinge arm 6.

In addition, according to the hinge arm damper mechanism 31 in the present embodiment, the kinetic force of the racks 33 and 33 from the extension portions 33*a* and 33*a* is reliably received by the contact surfaces 35*a* and 35*a* of the slide bars 35 and 35, and is reliably transmitted to one end portion of are aligned, restricted, and held by the fitting portions 35*b* and 35*b* of the slide bars 35 and 35. Therefore, the braking force of the springs 34 and 34 more effectively acts on the racks 33 and 33, and it is possible to more reliably buffer the rotational torque applied to the hinge arm 6.

In addition, the racks 33 and 33 are guided by guide portions 36*a* and 36*a* of the case 36 configuring the housing, and convert the rotational motion of the pinion gear 32 into the linear motion. However, a reaction force of restricting the linear motion of the racks 33 and 33 is applied to the guide portions 36*a* and 36*a*, and a force of distorting the housing acts on the guide portions 36*a* and 36*a*. However, according to the hinge arm damper mechanism 31 in the present embodiment, the reinforcement ribs 36*d* and 36*d* are formed outside the portion where the guide portions 36*a* and 36*a* of the housing are formed, and the reinforcement ribs 36*d* and 36*d* face the force of distorting the housing. Therefore, even when the force of distorting the housing is applied to the housing from the racks 33 and 33, the housing is prevented from deforming, and the rotational motion of the pinion gear 32 is reliably converted into the linear motion of the racks 33 and 33.

In the above-described embodiment, a case has been described where the reinforcement ribs 36*d* and 36*d* bulging in the direction perpendicular to the linear motion direction of the racks 33 and 33 are formed. However, the reinforcement ribs bulging in the direction parallel to the linear motion direction of the racks 33 and 33 may be formed.

In addition, in the hinge arm damper mechanism 31 according to the above-described embodiment, a configuration may be adopted so that an adjustment member for adjusting the initial braking force of the springs 34, 34 is provided on one end portion side or the other end portion side of the springs 34 and 34. For example, the adjustment member includes a plate member or a washer disposed between the springs 34 and 34 on the end walls 36*b* and 36*b* of the case 36. In addition, the adjustment member can be configured as follows. The end wall 36*b* side of the partition wall 36*c* is partially deleted over a predetermined length, and a position of the plate member which comes into contact with both ends of the springs 34 and 34 is made variable in an expanding direction of the springs 34 and 34. According to these configurations, the initial braking force of the springs 34 and 34 is adjusted by the adjustment member. In this manner, the buffering force achieved by the hinge arm damper mechanism 31 can be easily set to a desired buffering force. Therefore, it is possible to easily adjust the hinge arm damper mechanism 31 having a required damper effect.

In addition, in the hinge arm damper mechanism 31 according to the above-described embodiment, a case has been described where the two springs 34 and 34 are disposed in parallel with each other. However, a configuration may be adopted so that three or more springs are disposed in parallel with each other, or one spring is disposed alone without using any parallel configuration. In a case where the spring is disposed alone, a configuration is adopted so that the spring 34 on a base side of the extension portion 33*a* of the rack 33 is left behind. In this manner, the rack 33 is not tilted, and the linear motion of the rack 33 is received by the spring 34. Accordingly, the force is efficiently transmitted. In addition, in the hinge arm damper mechanism 31 according to the above-described embodiment, the respective sets of the springs 34 and 34 are symmetrically disposed at the facing positions around the pinion gear 32. However, a configuration may be adopted as follows. Without being symmetrically disposed, a plurality of the springs 34 or one spring 34 is disposed only on one side of the pinion gear 32.

INDUSTRIAL APPLICABILITY

In the above-described embodiment, a case has been described where the hinge arm damper mechanism 31 is applied to the inward tilting window 2. However, the hinge arm damper mechanism 31 may be applied to an outward tilting window which is tilted to an outdoor side. In addition, for example, a highly improved operation effect can be achieved, even when the hinge arm damper mechanism 31 is used for not only the tilting window but also a door mechanism of a device for opening and closing a heavy door.

REFERENCE SIGNS LIST

1: sash tilting angle locking mechanism
2: inward tilting window
3: window frame
3*a*: left vertical frame
3*b*: right vertical frame
3*c*: upper frame
3*d*: lower frame
4: sash
4*a*: left vertical frame
4*b*: right vertical frame
4*c*: upper frame
4*d*: lower frame
5: glass plate
6: hinge arm
11: slide rail
11*f*: slide surface
11*g*, 11*h*: hole
12: slide piece
13: locking member
14: locking spring
15: unlocking plate
16: latch member
17: latch spring
18: rail cap
19: operation lever
31: hinge arm damper mechanism,
32: pinion gear
33: rack
34: heavy load spring (elastic member)
35: slide bar (restriction member)
36: case
37: cover

The invention claimed is:

1. A hinge arm damper mechanism for buffering a rotational torque applied to a hinge arm by a weight of a mover in an opening and closing device in which the mover opens from a fixed frame due to the weight of the mover, the mechanism comprises:

a pinion gear disposed by being connected to the other end of the hinge arm which connects between a frame of the fixed frame and a frame of the mover and holds the mover in a state of being tilted at a predetermined angle to the fixed frame while of which one end being attached to the frame of the mover and of which the other end being disposed at a rotation center of the hinge arm;

a rack that is disposed in a pair at positions facing each other across a rotation center of the pinion gear, that moves straight in a direction where the rack move away from each other in response to rotation of the pinion gear, that has an extension portion in a direction intersecting a direction in which the rack moves straight, and that meshes with the pinion gear to convert a rotational motion of the pinion gear into a linear motion;

an elastic member that is disposed in a pair at positions facing each other via each of the rack around the rotation center of the pinion gear, that receives a kinetic force of the rack from the extension portion to one end portion, and that brakes the linear motion of the rack; and a housing that comprises a box-shaped case and a plate-shaped cover, that is disposed on a facing surface in the frame of the fixed frame which faces the frame of the mover, that includes a gear support portion for rotatably supporting the pinion gear by shaft portions on both side surfaces of the pinion gear being fitted into an opening portion of the cover and an opening portion of the case, in the shaft portions coaxially with the shaft portions a connection portion that is fitted into the other end of the hinge arm being formed, guide portions for guiding the linear motions of the racks being formed by inner walls of the case which come into contact with side surfaces of the racks, and reaction force support portions being configured by end walls of the case for receiving reaction forces generated in the elastic members by braking the linear motions of the racks, and that accommodates the pinion gear, the racks, and the elastic members, wherein the mover is held in a state of being opened at a predetermined angle to the fixed frame by a mover opening angle locking mechanism of the opening and closing device that comprises:

a slide rail that is attached on a facing surface in the frame of the mover which faces the frame of the fixed frame, and that has a track and a slide surface extending along a longitudinal direction of the frame of the mover, on the slide surface holes are open at predetermined positions corresponding to a tilting angle of the mover, a slide member that is attached to the slide rail movably along the track, that supports one end of the hinge arm swingably, and that moves in one direction when the mover is opened and one end of the hinge arm swings, a locking member of which one end is pivotably attached to the slide member, that moves on the track in the one direction together with the slide member while the other end moves ahead, a second elastic member that is disposed between the slide member and the locking member, that biases the other end of the locking member toward the slide surface and makes the other end of the locking member to come into sliding contact with the slide surface when the slide member moves in the one direction, and that makes the other end of the locking member to engage with one of the holes, an unlocking member that is attached to the slide rail to be movable along the slide surface, and that moves along the slide surface between an unlocking position where a tip located ahead when the unlocking member moves in the one direction pushes up the other end of the locking member engaging with the hole from the hole and a retreat position where the tip does not push up the other end of the locking member from the hole, and a third elastic member that biases the unlocking member to the retreat position along the slide surface.

2. The hinge arm damper mechanism according to claim 1, wherein the mover is a sash, the fixed frame is a window frame, and the opening and closing device is a tilting window.

3. The hinge arm damper mechanism according to claim 1, wherein a plurality of the elastic members are disposed in parallel, and each one end portion of the elastic members shares and receives the kinetic force of the rack.

4. The hinge arm damper mechanism according to claim 1, wherein a reinforcement rib rising in a direction intersecting a linear motion direction of the rack or in a direction parallel to the linear motion direction of the rack is formed outside a portion where the guide portion of the housing is formed.

5. The hinge arm damper mechanism according to claim 1, wherein an adjustment member for adjusting an initial braking force of the elastic member is provided on one end portion side or the other end portion side of the elastic member.

* * * * *